US006164928A

United States Patent [19]

Agner

[11] Patent Number: 6,164,928

[45] Date of Patent: Dec. 26, 2000

[54] PUMP WITH OPENABLE SEAL

[75] Inventor: Ivo Agner, Bad Homburg, Germany

[73] Assignee: Luk Fahrzeug-Hydraulik GmbH & Co. KG, Germany

[21] Appl. No.: 09/238,806

[22] Filed: Jan. 28, 1999

[30] Foreign Application Priority Data

Jan. 28, 1998 [DE] Germany ..... 198 03 096

[51] Int. Cl.[7] ..... F04B 49/00; F01C 21/16

[52] U.S. Cl. ..... 417/310; 417/220; 418/30

[58] Field of Search ..... 417/310, 220, 417/559, 223, 204; 418/30

[56] References Cited

U.S. PATENT DOCUMENTS

| | | | |
|---|---|---|---|
| 3,174,435 | 3/1965 | Sisson et al. | 103/126 |
| 4,697,565 | 10/1987 | Kobayashi et al. | 123/449 |
| 5,081,907 | 1/1992 | Nagel et al. | 91/497 |
| 5,267,840 | 12/1993 | Snow et al. | 417/310 |
| 5,289,681 | 3/1994 | Iwata | 60/428 |
| 5,540,560 | 7/1996 | Kimura et al. | 417/223 |
| 5,545,014 | 8/1996 | Sundberg et al. | 417/204 |
| 5,716,201 | 2/1998 | Peck et al. | 418/30 |
| 5,807,090 | 9/1998 | Agner . | |
| 6,042,343 | 3/2000 | Semba et al. | 417/220 |

FOREIGN PATENT DOCUMENTS

| | | |
|---|---|---|
| 41010117A1 | 7/1991 | Germany . |
| 0426427 | 4/1935 | United Kingdom . |
| 0752060 | 7/1956 | United Kingdom . |
| 0862662 | 3/1961 | United Kingdom . |
| 0943529 | 12/1963 | United Kingdom . |
| 0982014 | 2/1965 | United Kingdom . |
| 1075333 | 7/1967 | United Kingdom . |
| 1125574 | 8/1968 | United Kingdom . |
| 1552175 | 9/1979 | United Kingdom . |
| 2145773 | 4/1985 | United Kingdom . |

OTHER PUBLICATIONS

Trutnovsky, Karl, "Berührungsdichtungen an ruhenden und bewegten Maschinenteilen", *Konstruktionsbücher*, 1958.

*Primary Examiner*—Teresa Walberg
*Assistant Examiner*—Jeffrey C Pwu
*Attorney, Agent, or Firm*—Ostrolenk, Faber, Garb & Soffen, LLP

[57] ABSTRACT

A pump for supplying fluid, in particular hydraulic oil, comprises a drive shaft extending into the interior of the pump housing and the shaft is mounted on at least one bearing device lubricated by a partial flow of the fluid supplied. A sealing device seals the radial gap between the housing of the pump and the drive shaft. The sealing device comprises a sealing ring of substantially U-shape cross-section. One arm of the U forms a first sealing portion resting against the drive shaft under pre-stress. The other arm of the U forms a second sealing portion resting under pre-stress against a sealing face of the housing surrounding the drive shaft. The sealing ring has a sealing area connecting the first and second sealing portions and forming the base of the U and facing the interior of the pump so that the first and second sealing portions extend from the sealing area in a direction away from the interior of the pump.

8 Claims, 4 Drawing Sheets

PUMP WITH OPENABLE SEAL

BACKGROUND OF THE INVENTION

The present invention relates to a pump for supplying a fluid, in particular hydraulic oil, comprising a drive shaft extending into the interior of the pump and mounted on at least one bearing device lubricated by a leakage flow of fluid, and a sealing device sealing the gap between the housing of the pump and the drive shaft.

Pumps of the type described here, in particular hydraulic pumps, are known. They are situated above an oil sump, for example, of an automatic gearbox in a motor vehicle. It is not possible to lubricate the bearings of the pumps with grease since the grease is flushed out by the oil spray inside the gearbox. A rotary shaft seal and an oil leakage bore are thus normally provided, the oil leakage bore being arranged in such a way that the bearing of the pump is lubricated with oil during the operation of the pump and that the leaking oil can escape by way of the leakage space. It has been found that when the pump is stopped, oil can escape by way of the bearing device, so that the pump runs empty. This means that oil present in the pump chamber escapes, so that the pump chamber fills with air. As a result of the air present in the pump chamber the starting behavior of the pump is permanently affected.

SUMMARY OF THE INVENTION

An object of the invention is therefore to provide a pump of the type described above which does not have these drawbacks.

The invention provides a pump for supplying a fluid, the pump comprising a drive shaft extending into the interior of the pump and mounted on at least one bearing device which is lubricated by a leakage flow of fluid, and a sealing device sealing the gap between the housing of the pump and the drive shaft. The sealing device comprises a sealing ring of substantially U-shape cross-section. One arm of the U forms a first sealing portion resting against the drive shaft under pre-stress. The other arm of the U forms a further sealing portion resting under pre-stress against a sealing face surrounding the drive shaft. The sealing ring has a sealing area connecting the first and second sealing portions and forming the base of the U and also facing the interior of the pump so that the sealing portions extend from the sealing area in a direction away from the interior of the pump.

Thus, ambient pressure can penetrate into the inner space between the sealing portions of the U-shaped sealing ring. During operation of the pump, pressure prevailing in the interior of the pump housing can lift away a sealing portion, so that air present in the interior of the pump and/or leaking oil if present can escape from the interior of the pump. If the pump is stopped, however, the pressure prevailing in the interior of the pump is thus lost, so that the sealing portions of the sealing ring rest securely against the drive shaft and the sealing area, so that the pump is closed off practically hermetically and the escape of oil is prevented. When the pump is started again, a pump unit present in the interior of the said pump is filled with oil completely and displays an optimum starting behavior.

Other features and advantages of the present invention will become apparent from the following description of the invention which refers to the accompanying drawings.

BRIEF DESCRIPTION OF THE DRAWINGS

Embodiments of the invention are now described with reference to the accompanying drawings, in which.

DESCRIPTION OF THE INVENTION PREFERRED EMBODIMENTS

Figure 1:
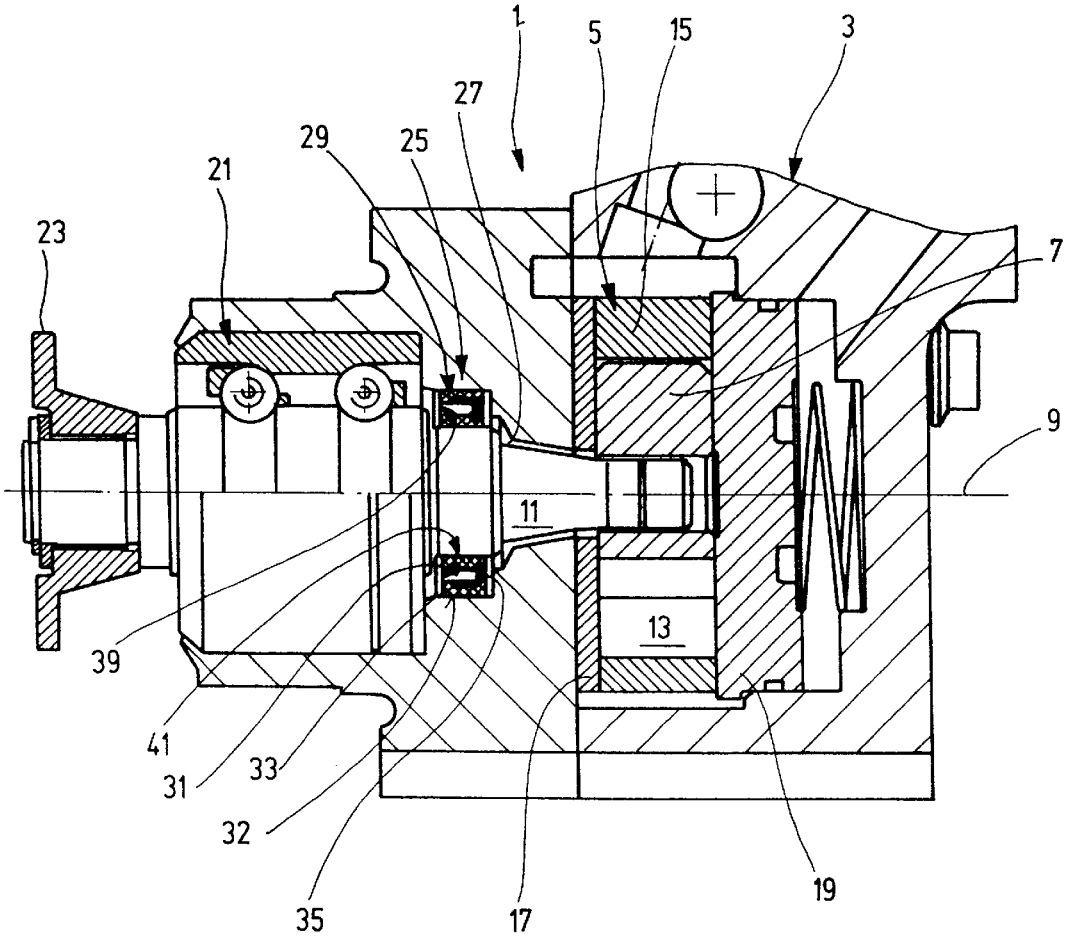
FIGS. 1 to 3 show longitudinal sectional views of different embodiments of pumps for supplying oil.

It is assumed below that the pump described here is a pump for supplying hydraulic oil, as used for example in hydraulically controlled gearboxes. The pump is generally arranged in the housing of a gearbox and can be situated above the oil sump. In the drawings the pump shown is a so-called vane-cell pump, including a pump unit which is provided with a rotor having radially displaceable vanes and which is rotatably mounted inside a lifting ring. A respective free space with a variable volume is situated between each two successive vanes, so that at least one suction region and one pressure region are formed. It is also possible, however, for the pump to supply any desired fluid and/or to be constructed in the form of an axial or radial piston pump, designs of which are known.

FIG. 1 shows a first embodiment of a pump 1 which comprises a pump unit 5 situated in a housing 3. The pump unit 5 in this case comprises a rotor 7 provided with slots which extend in the radial direction, i.e. at right angles to an axis of rotation 9 of a drive shaft 11, and into which radially displaceable vanes 13 are inserted. The rotor 7 rotates inside a lifting ring 15 which surrounds an inner space, which space is elliptical in the broadest sense. The vanes 13 slide along the inner face of the ring 15 as the rotor 7 rotates. Side plates 17 and 19 are provided to the right and left of the rotor 7 and the lifting ring 15. The drive shaft 11, which is mounted in the housing 3 by means of a suitable bearing device 21, for example in the form of a rolling or sliding bearing, engages in the rotor 7. In this embodiment, a driving wheel 23 is provided at the end of the drive shaft 11 projecting out of the housing 3. The driving wheel 23 is illustrated only in part and is constructed for example as a belt pulley or a gearwheel and transmits the driving moment to the drive shaft 11.

A sealing device 25, which seals the inner space of the pump 1 receiving the pump unit 5 from the surrounding environment, is situated between the bearing device 21 and the pump unit 5.

A free space 27 surrounds the drive shaft 11 and is situated between the pump unit 5 and the sealing device 25. Leaking oil can enter the space 27 during the operation of the pump 1. Leaking oil is oil escaping from the operating or high pressure side, for example, through gaps between the rotor and side plates or thrust plates. This oil is used for lubricating the bearing device 21, which is here constructed in the form of a two-row ball bearing or rolling bearing and is dimensioned such that the forces acting through the drive wheel 23 at right angles to the axis of rotation 9 are securely intercepted.

To allow the leaking oil to pass through to the bearing device 21, the sealing device 25 is provided with a sealing ring 29 which is substantially U-shaped in cross-section. The sealing ring 29 comprises two sealing portions 31 and 33, which form the arms of the U and which extend substantially parallel to the axis of rotation 9 of the drive shaft 11. They are joined to each other by a sealing area 35 extending substantially at a right angle to the axis of rotation 9 of the drive shaft 11. The sealing ring 29 is designed such that its sealing portions 31 and 33 are pre-stressed, i.e. are spread apart, so that the sealing ring 29 is firmly retained. In this case, the sealing ring 29 is arranged in such a way that the sealing region 35 faces the inner space of the pump 1, which receives the pump unit 5, whereas the sealing portions 31 and 33 extend outwards from the interior of the pump 1. If an overpressure builds up as a result of the leaking oil in the free space 27 during the operation of the pump 1, the leaking oil can lift up one of the sealing portions, for example the sealing portion 31 resting against the drive shaft 11 and can then reach the bearing device 21. From there the leaking oil then escapes to the outside. It is also possible to design the sealing ring 29 in such a way that, in the event of an over-pressure in the free space 27, the outer sealing portion 33, which surrounds the drive shaft 11 and the sealing ring 29, will be lifted away from a sealing face 37. It should be noted that only one sealing portion is lifted away in each case, either the inner sealing portion 31 or the outer sealing portion 33. The other sealing portion in each case rests in a sealed manner against the associated abutment face and thus firmly retains the sealing ring 29. It is also possible, however, to provide an additional mechanical stop, for example a circlip, for retaining the sealing ring axially.

In the embodiment of the sealing ring 29 illustrated here, a spring member 39 is provided which rests in an annular manner in the inner space of the sealing ring 29 formed in the sealing portions 31 and 33 and which acts with an additional pre-stressing force upon the inner sealing portion 31 resting against the outer face of the drive shaft 11.

In principle, the sealing ring 29 rests with a certain pre-stressing between the outer face of the drive shaft 11 and the sealing face 37, so that the sealing portions 31 and 33 are pressed against the drive shaft 11 and the sealing face 37, respectively. These forces used for sealing purposes can be increased by the spring member 39.

When the pump 1 is stopped, over-pressure is no longer produced in the interior of the housing 3. It is, in fact, possible for the oil supplied by the pump to flow back to a tank situated at a lower level and for an under-pressure to occur in the region of the pump unit 5 and the free space 27. It has been found that with an under-pressure in the free space 27, the atmospheric over-pressure present between the sealing portions 31 and 33 ensures that the sealing portions 31 and 33 rest in a sealed manner against the drive shaft 11 and the sealing face 37, respectively. This prevents air from being sucked in and thus prevents the pump 1 from running empty. The sealing device 25 or the sealing ring 29 thereof thus acts as a non-return valve.

Figure 2:
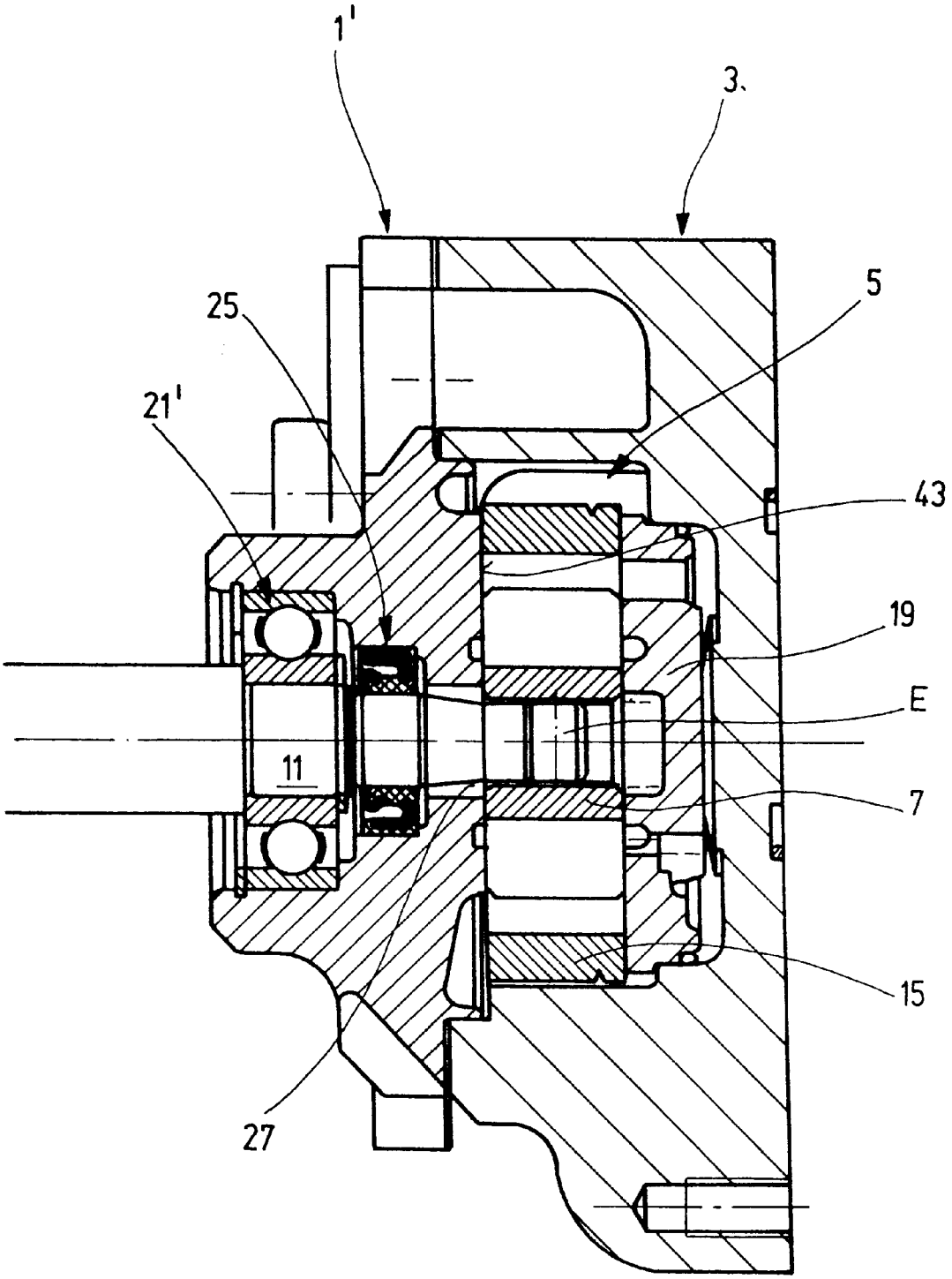

FIG. 2 shows a further embodiment of a pump 1' constructed in the form of a vane-cell pump.

The same parts are provided with the same reference numerals, so that in this respect reference can be made to the description relating to FIG. 1.

A pump unit 5, which has only one side plate 19, is provided in the interior of the housing 3 of the pump 1'. The opposite second side plate has been omitted. The unit formed by the rotor 7 and the lifting ring 15 rests directly against a flat housing wall 43 which performs the function of a second side plate.

The rotor 7 is set in rotation by one end E of the drive shaft 11 which is mounted in an overhung manner. The drive shaft 11 is additionally mounted outside the housing 3 of the pump 1', so that a drive wheel or a belt pulley is attached to the drive shaft 11 at a distance from the pump 1'. This means that the forces introduced into the drive shaft 11 do not act upon a drive wheel arranged directly in the region of the housing 3. It is thus possible for a considerably smaller bearing device 21', which guides the drive shaft 11 in the housing 3 of the pump 1', to be used. A sealing device 25, which is designed identically to the one explained with reference to FIG. 1, in this case too rests between the bearing device 21' and the inner space which receives the pump unit 5.

The bearing device 21' is lubricated in turn by leaking oil which passes out of the pump unit 5 into a free space 27 which surrounds the drive shaft 11 and which is situated between the sealing device 25 and the pump unit 5. As explained with reference to FIG. 1, the leaking oil reaches the bearing device 21' and is used for lubrication thereof.

In this embodiment, the sealing device 25 also acts as a non-return valve, so that leaking oil can pass from the free space 27 to reach the bearing device 21'. It is not possible, however, for air to pass from the surrounding environment into the interior of the pump 1' to reach the pump unit 5, or for oil to escape in the direction of the bearing device without pressure when the pump is stopped. The pump 1' cannot therefore run empty when it is stopped.

Figure 3:
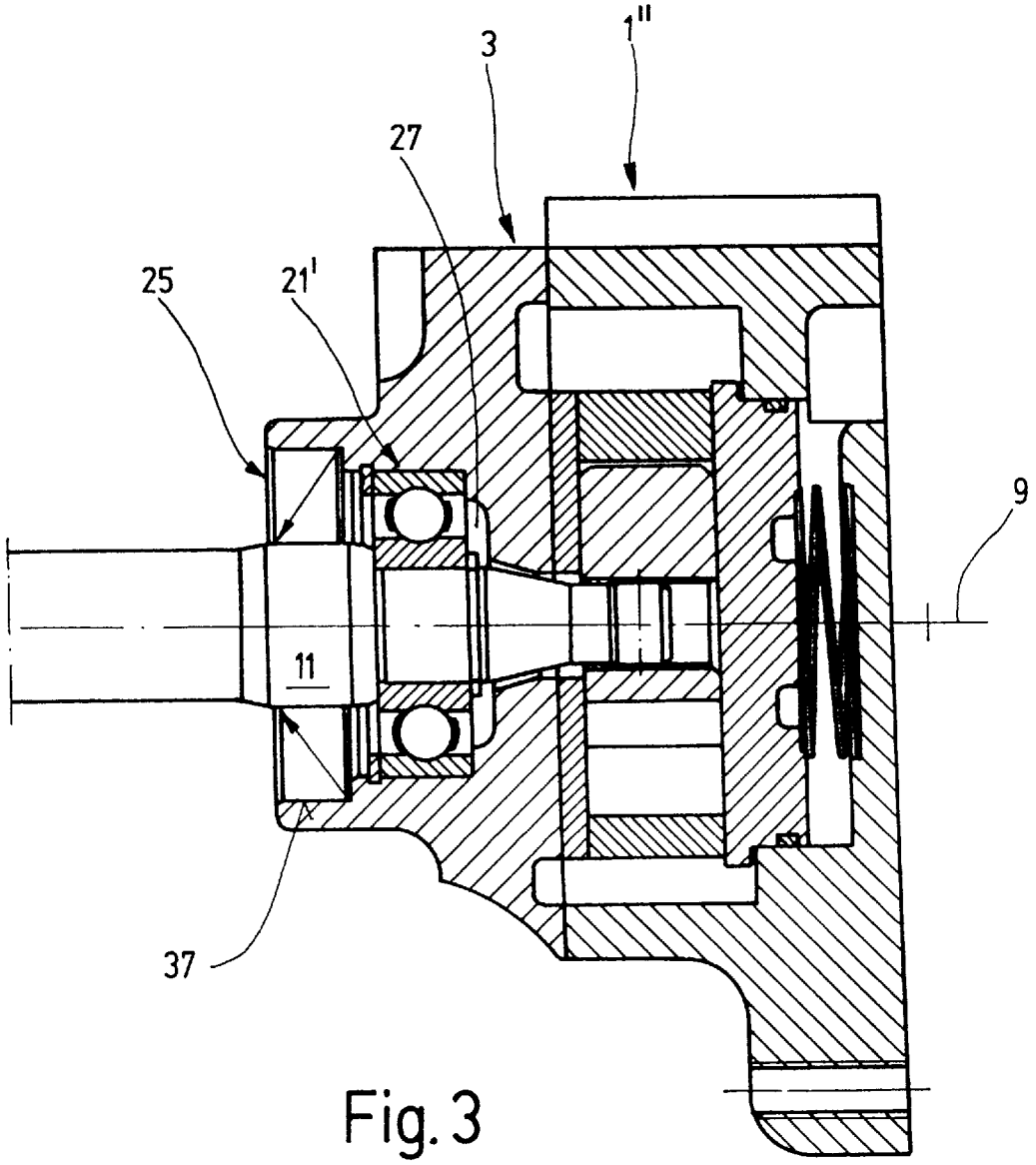

FIG. 3 is a longitudinal section of a further embodiment of a pump 1", which in principle is designed in the same way as the pump 1' shown in FIG. 2. The only difference is that the sealing device 25, which in this case is indicated merely by a technical symbol, is arranged on the side of the bearing device 21' remote from the pump unit 5. Oil leaking during operation of the pump 1" and entering the free space 27 can thus pass freely to the bearing device 21' and can pass therethrough. In this way, the bearing device 21' is cooled and lubricated. The leaking oil can then pass further through the sealing device 25.

The sealing device 25 is designed identically to the one explained with reference to FIGS. 1 and 2. It is thus provided with a sealing ring which is substantially U-shaped in section and which comprises two sealing portions which extend substantially parallel to the axis of rotation 9 of the drive shaft 11 and which are joined by a sealing area extending at a right angle to the axis of rotation. The sealing ring is arranged such that the sealing region is situated on the side of the bearing device 21', i.e. faces the interior of the pump 1", whereas in this case the sealing portions are directed away to the left from the interior of the pump 1".

In addition, the sealing ring of the sealing device 25 illustrated in FIG. 3 acts as a non-return valve. Although it is possible for leaking oil to escape from the interior of the pump 1", if the pump 1" is not operating, an under-pressure could occur in the free space 27 as a result of oil flowing back. In this case, as a result of the pre-stressing, the sealing portions 31 and 33 of the sealing ring 29 of the sealing device 25 rest tightly against the outer face of the drive shaft 11 and the sealing face 37, so that no air can enter the interior of the pump 1". In addition, when the pump is stopped, no oil can escape past the sealing device 25. In this way, empty running of the pump is reliably prevented.

In order to improve the sealing action of the sealing device 25, at least two sealing lips 41 (FIGS. 1 and 4), which rest against the surface of the drive shaft 11, can be provided on the inside of the sealing portion 31 facing the drive shaft 11. If, therefore, one of the sealing lips displays an inadequate sealing action as a result of contamination, the second sealing lip can still ensure a secure sealing of the inner space of the pump and empty running of the pump when stopped can be prevented.

It is clear from all the above that the sealing device 25 can comprise a sealing ring 29 arranged stationary in the housing 3 and provided on its side facing the drive shaft 11 with a sealing portion 31 sealing the interior of the pump from the surrounding environment in the manner of a non-return valve. In addition, at least two sealing lips 41 can be provided on the inner face of the sealing portion 31 facing the drive shaft 11. It is also possible, in accordance with all the above, to design the sealing ring 29 so as to be stationary on the drive shaft 11 and to design the outer sealing portion 33 in form of a non-return valve by abutment against a sealing face 37. In this case a spring member, which acts upon the outer sealing portion 33 with a pre-stressing force, can then cooperate with the outer sealing portion 33. Sealing lips can then also be provided on the outer sealing portion 33.

Figure 4:
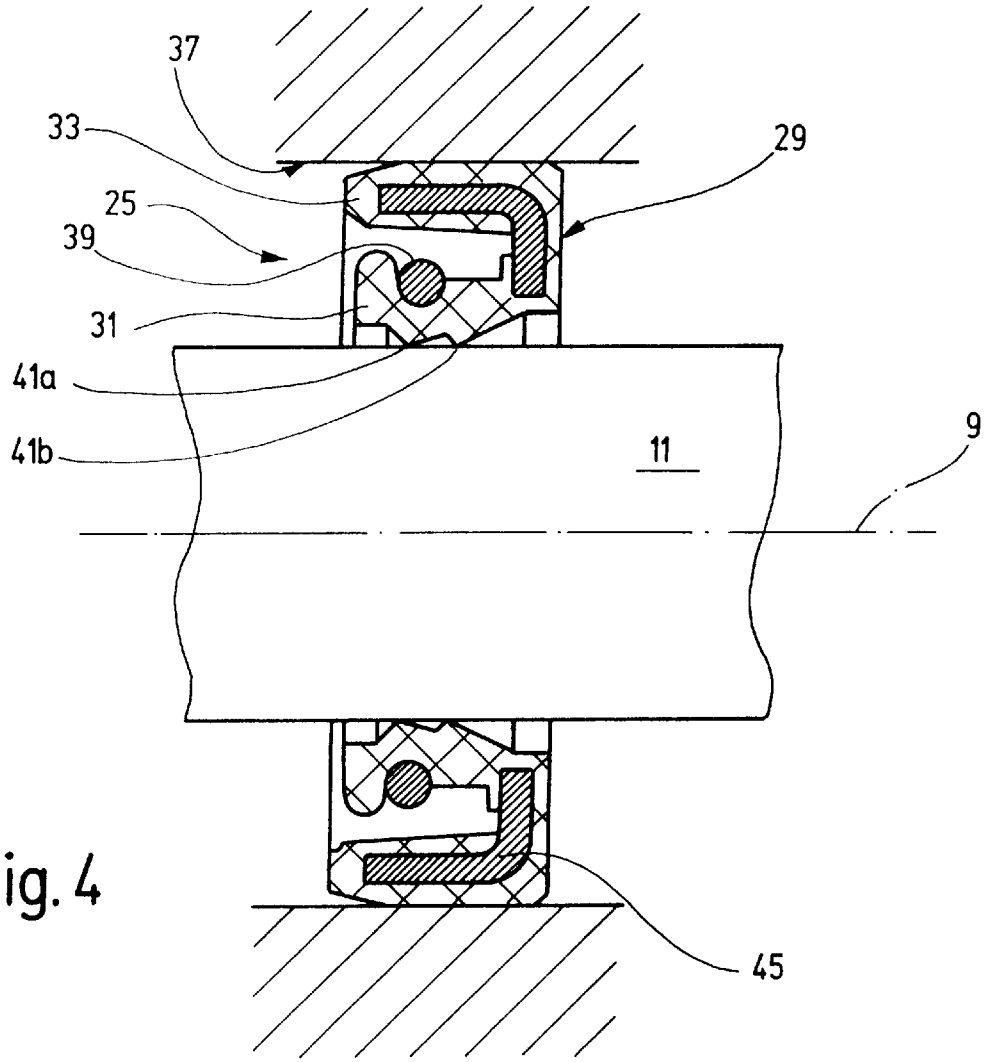
FIG. 4 shows a simplified detailed enlargement of the sealing device of FIGS. 1 and 2.

FIG. 4 shows a simplified detailed enlargement, namely a sealing device 25 mounted on a drive shaft 11. The illustration of the bearing device and other details of the pump have been omitted here.

FIG. 4 shows that the sealing device 25 comprises a sealing ring 29 which comprises an inner sealing portion 31 facing the drive shaft 11 and an outer sealing portion 33 facing an outer sealing face 37. On account of the inherent resilience of the inner sealing portion 31 on the one hand, and as a result of the pre-stressing force of a spring member 39 constructed in the form of a spring ring for example on the other hand, the inner sealing portion 31 is pressed against the peripheral face of the drive shaft 11. It is clear from the enlargement according to FIG. 4 that the sealing device 25 or the sealing ring 29 thereof is provided with two sealing lips 41*a* and 41*b*, by which the sealing ring 29 rests on the peripheral face of the drive shaft 11 and the lips are arranged spaced from each other at a distance measured in the direction towards the axis of rotation 9. If dirt passes into the sealing area together with oil leaking through between the sealing lips 41*a*, 41*b* and the peripheral face of the drive shaft 11, then it is possible to ensure that at least one of the sealing lips 41*a*, 41*b* still remains engaged with the surface of the drive shaft 11 in a sealed manner and maintains the sealing function of the sealing device 25.

In an alternate embodiment, sealing lips like 41*a*, 41*b*, may be provided on the exterior surface of the outer sealing portion 33, where they press against the sealing surface 37 inside the pump housing.

This enlarged illustration also shows a reinforcement device 45 which increases the stability of the sealing ring 29 and prevents the sealing portion 33 from being lifted away. If the spring member 39 is associated with the outer sealing portion 33 resting against the sealing face 37, the reinforcement device will be associated with the inner sealing portion 31.

FIG. 4 shows that an over-pressure in the interior of the pump can act upon the surface of the sealing portion 31 which faces the drive shaft and which is situated to the right of the sealing lip 41*b*. In this way, the internal diameter of the sealing ring 29 can be enlarged radially against the inherent resilience of the sealing portion 31 and against the loading of the spring member 39, so that first the sealing lip 41*b* and then the sealing lip 41*a* are lifted away; the leaking oil can then reach the bearing device (not illustrated in FIG. 4).

The Figures also show that the sealing device 25 can be assembled in a relatively simple manner. In the embodiments of the pump 1' according to FIG. 1 or of the pump 1' according to FIG. 2, first the sealing device 25 is inserted into the housing 3, and then the drive shaft 11 provided with the pre-assembled bearing device 21 and 21' respectively is inserted.

As a whole it is clear that it is possible to produce, in a simple manner, a non-return valve which provides lubrication of the bearing device of a pump during the operation and at the same time prevents empty running or empty suction of the pump. The pump cannot therefore run empty when stopped and is characterized by a particularly good starting behavior. At the same time, the pump is closed off by the non-return valve such that the suction and pressure ducts connected to the pump also do not run empty.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A pump for supplying a fluid comprising:

a pump housing with an interior and a sealing face defining the housing interior;

a drive shaft extending into the interior of the pump housing with a radial gap defined between the housing and the shaft;

at least one bearing device in the housing and on which the drive shaft is mounted, and the bearing device is lubricated by a leakage flow of fluid;

a sealing device sealing the gap between the housing of the pump and the drive shaft, the sealing device comprising a sealing ring of substantially U-shape cross-section having an exterior surface, having one arm of the U forming a first sealing portion and resting against the drive shaft under pre-stress and having another arm of the U forming a further sealing portion and resting under pre-stress against the sealing face of the housing and surrounding the drive shaft, the sealing ring having a sealing area connecting the first and second sealing portions and forming the base of the U and having an exterior corresponding to the exterior of the sealing ring, the U being oriented so that the exterior of the sealing area faces the interior of the pump housing and the sealing portions extend from the sealing area in a direction away from the interior of the pump.

2. A pump according to claim 1, further comprising a spring member cooperating with the sealing ring for improving the force of sealing applied by the ring.

3. A pump according to claim 2, wherein the spring member acts upon the first sealing portion resting against the drive shaft for providing an additional force pressing the said first sealing portion against the drive shaft.

4. A pump according to claim 1, wherein the first sealing portion resting against the drive shaft includes at least two sealing lips resting against the outer face of the drive shaft.

5. A pump according to claim 1, wherein the first sealing portion resting against the drive shaft is shaped and is of such strength as to act as a non-return valve, so that upon a predetermined over-pressure in the interior of the pump, the first sealing portion is lifted away from the drive shaft, and below the predetermined over-pressure or in the event of an under-pressure in the interior of the pump, the first sealing portion rests in a sealed manner against the drive shaft.

6. A pump according to claim 2, wherein the spring member acts upon the second sealing portion resting against the sealing face for providing an additional force pressing the said second sealing portion against the sealing face.

7. A pump according to claim 6, wherein the second sealing portion resting against the sealing face includes at least two sealing lips resting against the sealing face.

8. A pump according to claim 6, wherein the second sealing portion resting against the sealing face is so shaped and is of such strength as to act as a non-return valve, so that upon a predetermined over-pressure in the interior of the pump, the second sealing portion is lifted away from the said sealing surface, and below the predetermined over-pressure or in the event of an under-pressure in the interior of the pump, the second sealing portion rests in a sealed manner against the sealing face.

* * * * *